US009155389B2

(12) United States Patent
Choi et al.

(10) Patent No.: US 9,155,389 B2
(45) Date of Patent: Oct. 13, 2015

(54) SYSTEM FOR CONTROLLING SEAT EFFECT FOR FACILITY OF SHOWING PICTURES

(71) Applicant: CJ 4D PLEX CO., LTD., Seoul (KR)

(72) Inventors: Jae Sung Choi, Seoul (KR); Jin Yong Park, Daejeon (KR)

(73) Assignee: CJ 4D PLEX CO., LTD., Seoul (KR)

( * ) Notice: Subject to any disclaimer, the term of this patent is extended or adjusted under 35 U.S.C. 154(b) by 0 days.

(21) Appl. No.: 14/353,330

(22) PCT Filed: Dec. 6, 2012

(86) PCT No.: PCT/KR2012/010578

§ 371 (c)(1),
(2) Date: Apr. 22, 2014

(87) PCT Pub. No.: WO2013/125775

PCT Pub. Date: Aug. 29, 2013

(65) Prior Publication Data

US 2014/0318029 A1 Oct. 30, 2014

(30) Foreign Application Priority Data

Feb. 20, 2012 (KR) ..... 10-2012-0016887

(51) Int. Cl.
*A63G 31/16* (2006.01)
*A47C 1/12* (2006.01)
*A63J 25/00* (2009.01)

(52) U.S. Cl.
CPC ... *A47C 1/12* (2013.01); *A63J 25/00* (2013.01)

(58) Field of Classification Search
CPC ..... A63G 1/00; A63G 1/30; A63G 31/00; A63G 31/02; A63G 31/16; A47C 1/00; A47C 1/12
USPC ..... 472/59–61, 130; 434/55; 463/30, 31, 463/32, 33
See application file for complete search history.

(56) References Cited

U.S. PATENT DOCUMENTS 1,789,680 A * 1/1931 Gwinnett ..... 472/60
3,628,829 A * 12/1971 Heilig ..... 297/217.4
(Continued)

FOREIGN PATENT DOCUMENTS

CN 201643743 U 11/2010
JP 2008-311901 A 12/2008
(Continued)

OTHER PUBLICATIONS

International Search Report mailed Feb. 1, 2013 in PCT/KR2012/010578.
(Continued)

*Primary Examiner* — Kien Nguyen
(74) *Attorney, Agent, or Firm* — Plumsea Law Group, LLC

(57) ABSTRACT

Provided is a system for controlling a seat effect for a facility of showing pictures, and particularly, a user on a rear line may easily and safely control an effect provided to the user himself/herself even while a seat is in motion operation at the time of showing pictures by controlling an effect synchronized with pictures by relaying control information inputted from the user on the rear-line seat by using an effect controlling device of a front-line seat, in the facility of showing pictures, which provides the effect (for example, a water shot, an air shot, or a scent) synchronized with the pictures to the user on the rear-line seat.

6 Claims, 6 Drawing Sheets

(56) References Cited

U.S. PATENT DOCUMENTS

| | | | | |
|---|---|---|---|---|
| 3,865,430 | A | 2/1975 | Tanus | |
| 5,807,177 | A * | 9/1998 | Takemoto et al. | 463/47 |
| 6,224,491 | B1 * | 5/2001 | Hiromi et al. | 472/59 |
| 7,691,002 | B2 * | 4/2010 | Casey et al. | 472/59 |
| 7,866,747 | B2 | 1/2011 | Park | |
| 2010/0205867 | A1 | 8/2010 | Park | |
| 2011/0170945 | A1 | 7/2011 | Gagnon et al. | |
| 2011/0319180 | A1 | 12/2011 | Lee | |

FOREIGN PATENT DOCUMENTS

| | | | |
|---|---|---|---|
| KR | 10-0863280 | B1 | 10/2008 |
| KR | 10-1005320 | B1 | 1/2011 |
| KR | 10-2011-0139613 | A | 12/2011 |
| RU | 105 843 | U1 | 6/2011 |
| WO | 2011/162448 | A1 | 12/2011 |

OTHER PUBLICATIONS

Russian Notice of Allowance dated Nov. 25, 2013 in Russian Application No. 2012132215.

European Search Report dated Jul. 11, 2013 in European Application No. 13155826.4.

Korean Notice of Allowance dated May 29, 2012 in Korean Application No. 10-2012-0016887.

* cited by examiner

SYSTEM FOR CONTROLLING SEAT EFFECT FOR FACILITY OF SHOWING PICTURES

CROSS REFERENCE TO RELATED APPLICATION

This application is a US National Stage of International Application No. PCT/KR2012/010578 filed Dec. 6, 2012, which claims priority to Korean Patent Application No. 10-2012-0016887 filed Feb. 20, 2012, the contents of all of which are incorporated herein by reference in their entity.

FIELD OF THE INVENTION

The present disclosure relates to a system for controlling a seat effect for a facility of showing pictures, and particularly, a system for controlling a seat effect for a facility of showing pictures for a user on a rear-line seat to easily and safely control an effect provided to the user himself/herself even while a seat is in motion operation while showing pictures by controlling an effect synchronized with pictures by relaying effect control information inputted from the user on the rear-line seat by using an effect controlling device of a front-line seat, in the facility of showing pictures, which provides the effect (for example, a water shot, an air shot, or a scent) synchronized with the pictures to the user on the rear-line seat.

BACKGROUND

In a facility of showing pictures, such as a theater or a cinema, only the pictures were shown to spectators in the related art, but various effects have been provided to the spectators while the pictures have been shown in recent years.

A cinema of showing general pictures is a 2D cinema and a cinema of showing specially photographed pictures for the spectators to feel a 3D effect at the time of viewing the pictures is a 3D cinema, and a cinema for the spectators to view the pictures while feeling five senses by simulating the sense of touch, the sense of smell, and the like in addition to the senses of sight and hearing is a 4D cinema.

In the 4D cinema, a motion base that moves a seat on which the spectator sits is installed below the seat and special effect devices providing various effects to the spectators are installed on the seats and inner walls or a ceiling of the cinema.

When the spectator views a movie while sitting on the seat, the spectator may improve excitement and immersiveness on the movie while directly experiencing the motion synchronized with the picture and effects such as water, wind, smoke, flash, heat, and the like, not viewing only the picture.

In the 4D cinema which is being operated at present, a plurality of seat sets is placed, and the seat sets includes 4D effect devices that shoot water, wind, or scent installed on a back surface of a seat set positioned at a front line in addition to the motion bases. These 4D effect devices shoot materials that take a 4D effect to a spectator who sits on a seat set positioned on a rear line, from the back surface of the seat set positioned on the front line.

These 4D effect devices are controlled by a central device that controls the entire cinema and provide the same 4D effect to each of the spectators.

However, some of the spectators may dislike the 4D effect that is shot to their own faces. When the same 4D effect is provided to all the spectators, the 4D effect may cause displeasure in some spectators while showing the movie. Some spectators like the 4D effect, but when the 4D effect is provided more strongly than their own tastes, immersiveness on the movie which the spectator feels may be decreased.

Meanwhile, a plurality of seat sets installed in the 4D cinema is positioned to be adjacent for each of front lines and rear lines. In this case, a spectator who sits on the rear-line seat is unable to easily control the 4D effect device installed on the rear-line seat which the spectator himself/herself sits on while showing the pictures. If a switch for controlling the 4D effect shot from the front-line seat is attached to the front-line seat, the spectator who sits on the rear-line seat needs to control the 4D effect device attached to the back surface of the front-line seat by moving to the front-line seat in order to control the 4D effect provided to the spectator himself/herself. In the case where the seat is in motion operation, there is a risk that the spectator will be dropped or injured.

In order to solve the problem, wiring may be connected for each of front/rear-line seats of all the seat sets, but the wiring may be complicated between the seats and a problem may arise or a trouble may occur in the wiring due to the motion operation of the seats. Moreover, in the case where the wiring for controlling the 4D effect devices has already been installed complicatedly for each front/rear-line seat, if a new wiring for controlling the front-line seat on the rear-line seat is installed, the wiring becomes even more complicated.

Meanwhile, in the seats installed in the facility of showing the pictures, which provide the 4D effect in the related art, the spectator at the rear line is disable to optionally select the strength or type of the 4D effect that is spot from the front-line seat. All the spectators are provided with the 4D effect having the same type or strength because the spectator is disable to select the type or strength which the spectator himself/herself likes among the 4D effects.

SUMMARY

The present disclosure has been made in an effort to provide a system for controlling a seat effect for a facility of showing pictures for a user on a rear line to easily and safely control an effect provided to the user himself/herself even while a seat is in motion operation at the time of showing pictures by controlling an effect synchronized with pictures by relaying control information inputted from the user on the rear-line seat by using an effect controlling device of a front-line seat, in the facility of showing pictures, which provides the effect (for example, a water shot, an air shot, or a scent) synchronized with the pictures to the user on the rear-line seat.

According to a first aspect of the present disclosure, there is provided a system configured to provide an effect synchronized with a picture in a facility of showing pictures, comprising: a first controlling device of a seat configured to transmit control information including an effect type or an effect strength inputted from a user; a second controlling device positioned at a front space of the seat configured to provide the effect synchronized with the picture to a space in the seat; and a central control device configured to relay the control information received from the first controlling device to the second controlling device, wherein the central control device configured to verify a mapping between the first controlling device and the second controlling device for relaying the control information; and the second controlling device controls to provide the effect in accordance with the control information relayed through the central control device.

According to a second aspect of the present disclosure, there is provided system configured to provide an effect synchronized with a picture in a facility of showing pictures, comprising: a first controlling device of a seat configured to transmit control information including an effect type or an effect strength inputted from a user; and a second controlling device configured to provide the effect in accordance with control information received from the first controlling device, wherein the first controlling device and the second controlling device are, in advance, network-connected to each other through wireless communication; and the second controlling device controls to provide the effect synchronized with the picture to a space in the seat.

According to exemplary embodiments of the present disclosure, a user on a rear line can easily and safely control an effect provided to the user himself/herself even while a seat is in motion operation at the time of showing pictures by controlling an effect synchronized with pictures by relaying control information inputted from the user on the rear-line seat by using an effect controlling device of a front-line seat, in the facility of showing pictures, which provides the effect (for example, a water shot, an air shot, or a scent) synchronized with the pictures to the user on the rear-line seat.

Further, by relaying or transmitting/receiving control information through a wireless communication network or a wired communication network which has already been installed, thereby preventing the 4D effect from being stopped because the wiring is not additionally connected between motion seats even in a facility of showing pictures where a wiring is connected complicatedly in advance, and thus a trouble arises in the wiring due to the motion operation of the seat.

Furthermore, the user who sits on the rear-line seat conveniently selects the strength or type of the 4D effect from the front-line seat while showing the pictures to reduce displeasure caused due to the 4D effect at the time of showing the pictures, thereby increasing immersiveness of the pictures.

DETAILED DESCRIPTION

Figure 1:
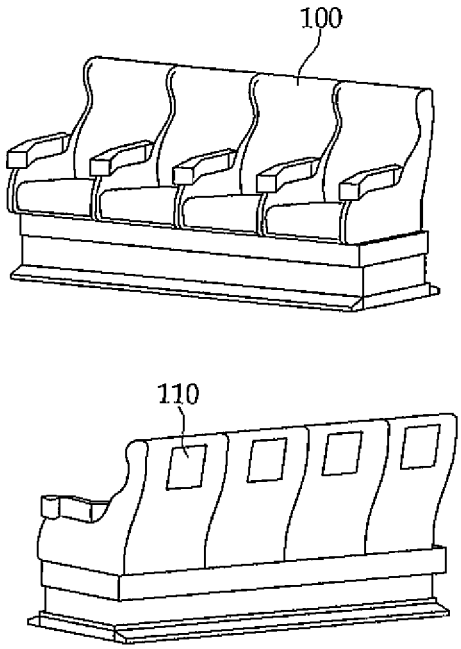
FIG. 1 is an exemplary diagram of a seat in a facility of showing pictures applied to the present disclosure.

Hereinafter, exemplary embodiments of the present disclosure will be described in detail with reference to the accompanying drawings. The configurations of the present disclosure and the resulting operational effects will be apparently appreciated through the detailed description described as below. Prior to the detailed description of the present disclosure, like reference numerals refer to like elements as possible even though like elements are shown in different drawings and it is noted that a detailed description of the known configurations will be omitted when it is judged that the known configurations may obscure the spirit of the present disclosure.

FIG. 1 is an exemplary diagram of a seat in a facility of showing pictures applied to the present disclosure.

In one example of the facility of showing pictures applied to the present disclosure, a plurality of seats constitutes one seat set 100. For example, FIG. 1 illustrates a structure in which four seats constitute one seat set 100. The seat set 100 is placed as a plurality of lines arranged in tiers from a screen side of the facility of showing pictures. The exemplary embodiment of the present disclosure may be applied to even the facility of showing pictures in which seats at the plurality of lines are arranged one by one as well as the seat set.

Herein, the seat installed in the facility of showing pictures includes a shooting device 110 that shoots water, wind or scent to a back surface of a seat positioned at a front line as well as a motion base. The shooting device 110 shoots water, wind or scent that causes a 4D effect to a user who sits on the seat from the back surface of the front-line seat.

Figure 2:
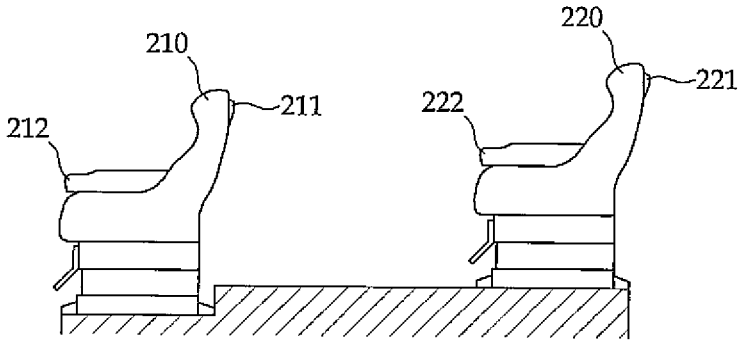
FIG. 2 is an explanatory diagram of a seat layout in the facility of showing pictures according to the exemplary embodiment of the present disclosure.

FIG. 2 is an explanatory diagram of a seat layout in the facility of showing pictures according to the exemplary embodiment of the present disclosure.

As illustrated in FIG. 2, a front-line seat 210 and a rear-line seat 220 are installed on a floor of the facility of showing pictures in tiers in the facility of showing pictures. The exemplary embodiment of the present disclosure may be applied to a facility of showing pictures in which the front-line seat 210 and the rear-line seat 220 are disposed by a predetermined distance.

As one example, the front-line seat 210 includes a selection switch 212 that enables the user to control the 4D effect and a shooting device 211 installed on the back surface of the seat. Further, the rear-line seat 220 includes a selection switch 222 that enables the user to control the 4D effect and a shooting device 221 installed on the back surface of the seat.

The user who sits on the rear-line seat 220 receives the 4D effect through the shooting device 211 installed on the back surface of the front-line seat 210. In this case, the user who sits on the rear-line seat 220 may control or turn on/off the 4D effect (for example, an air shot, a water shot or a scent) provided from the shooting device 211 of the front-line seat 210 through the selection switch 222.

Figure 3:
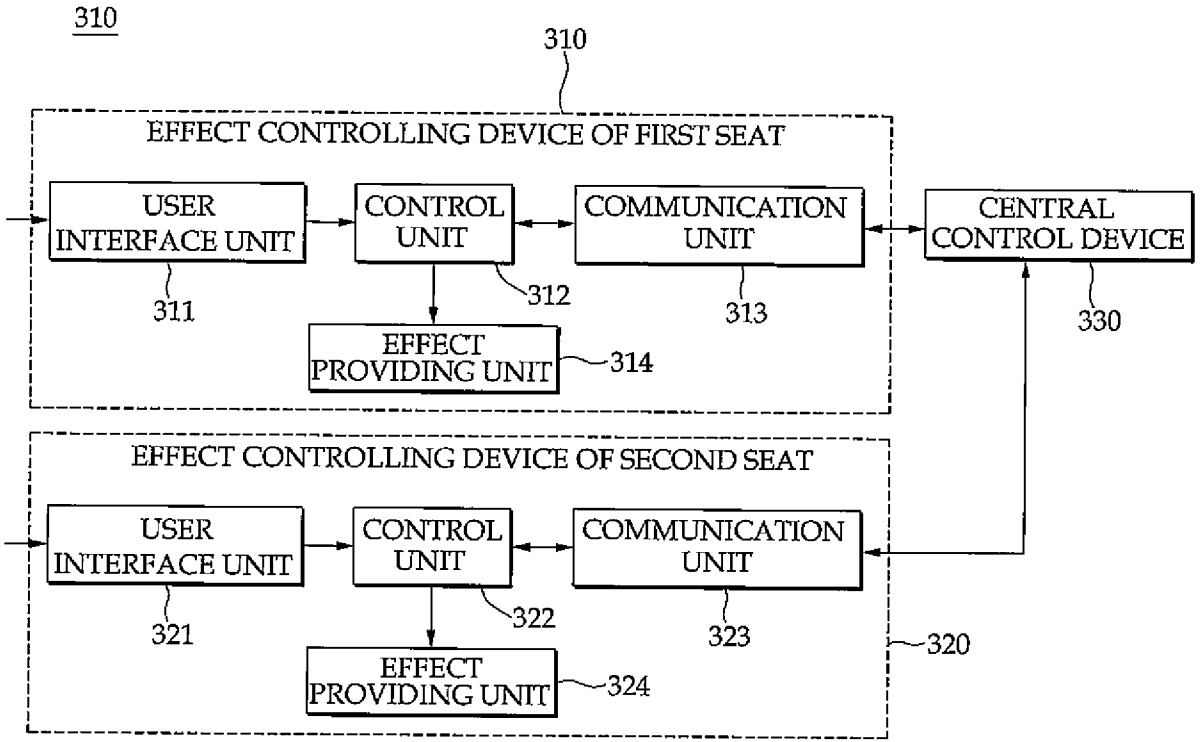
FIG. 3 is a configuration diagram of a system for controlling a seat effect for a facility of showing pictures according to a first exemplary embodiment of the present disclosure.

FIG. 3 is a configuration diagram of a system for controlling a seat effect for a facility of showing pictures according to a first exemplary embodiment of the present disclosure.

As illustrated in FIG. 3, a system 300 for controlling the seat effect in the facility of showing pictures according to the exemplary embodiment of the present disclosure includes a central control device 330, an effect controlling device 320 of the front-line seat hereinafter referred to as a 'second seat,' and an effect controlling device 310 of the rear-line seat, hereinafter referred to as a 'first seat'.

The effect controlling system 300 according to the exemplary embodiment of the present disclosure transmits inputted control information to the effect controlling device 320 of the second seat, hereinafter referred to as a 'second controlling device', through the central control device 330 when the user who sits on the first seat inputs the control information in the effect controlling device 310 of the first seat hereinafter referred to as a 'first controlling device'. Subsequently, the effect controlling device 320 of the second seat controls the 4D effect according to the control information which the user who sits on the first seat inputs.

Hereinafter, each of constituent members of the effect controlling system 300 according to the first exemplary embodiment of the present disclosure will be described.

The effect controlling device 310 of the first seat transmits the control information inputted by the user to a predetermined network address of the central control device 330. The effect controlling device 310 of the first seat stores a main path of the network of the central control device 330 in advance.

The central control device 330 relays the control information received from the effect controlling device 310 of the first seat to the effect controlling device 320 of the second seat with the predetermined network address. The central control device 330 restores a network address of the effect controlling device 320 of the second seat positioned at the front line or space of the first seat.

The effect controlling device 320 of the second seat provides an effect synchronized with a picture to the user who sits on the first seat positioned at the front line or space of the first seat. In this case, when the effect controlling device 320 of the second seat receives the control information relayed through the central control device 330, the effect controlling device 320 of the second seat controls the 4D effect according to the received control information.

To this end, the effect controlling device 310 of the first seat includes a user interface unit 311, a control unit 312, a communication unit 313 and an effect providing unit 314. The effect controlling device 320 of the first seat includes a user interface unit 321, a control unit 322, a communication unit 323 and an effect providing unit 324.

Constituent members of each of the effect controlling device 310 of the first seat and the effect controlling device 320 of the second seat will be described in sequence.

The user interface unit 311 of the effect controlling device 310 of the first seat is constituted by a selection switch for the user to input the control information and the like. The user interface unit 311 selects on/off, the type and the strength and the like of the 4D effect which the user desires by user's selection.

The communication unit 313 communicates with the central control device 330 through the network to transmit the control information. In this case, the network is connected through short-range wired and wireless communication networks, and is not limited to a specific communication network.

The effect providing unit 314 provides the 4D effect to the user who sits on the rear-line seat of the first seat.

The control unit 312 transmits the control information to the communication unit 313 so that the control information inputted through the user interface unit 311 is transmitted to the network address of the central control device 330.

The control unit 312 controls the 4D effect provided to the user by controlling the effect providing unit 314.

Meanwhile, in the effect controlling device 320 of the second seat, the communication unit 323 communicates with the central control device 330 to receive the control information transmitted from the effect controlling device 310 of the first seat. Herein, the communication unit 323 is connected with the central control device 330 through the network in advance. In this case, the network is connected through short-range wired and wireless communication networks, and is not limited to a specific communication network.

The effect providing unit 324 provides an effect synchronized with the picture to the user who sits on the first seat in the facility of showing pictures. For example, the effect providing unit 324 may provide at least one of a water shot effect, an air shot effect and the scent effect to the user.

In this case, when the control unit 322 receives the control information received through the communication unit 323, the control unit 322 controls the effect providing unit 324 according to the control information. The control unit 322 may receive the control information including at least one of whether or not a seat effect is provided, the effect type and the effect strength.

Figure 4:
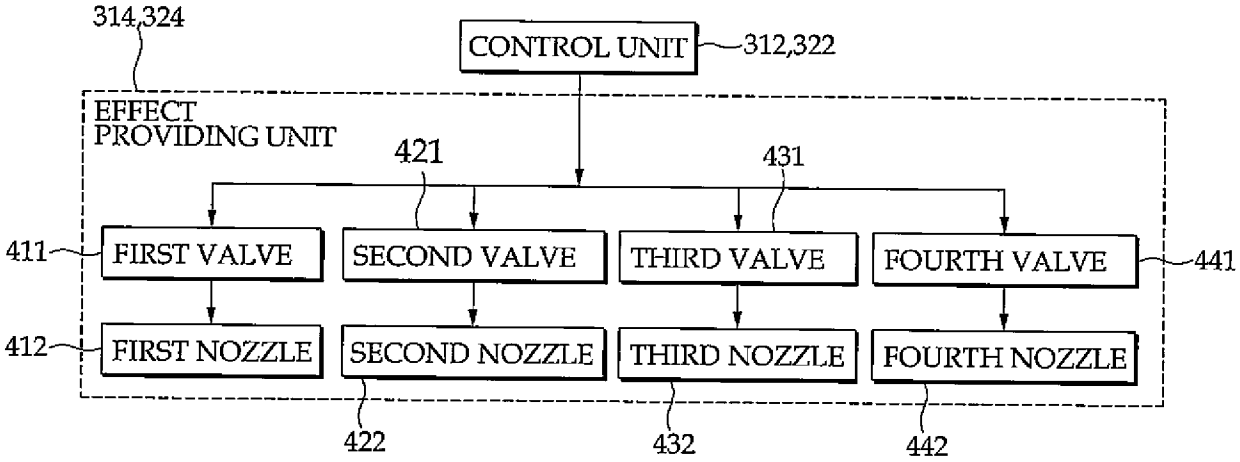
FIG. 4 is a detailed configuration diagram of an effect providing unit of FIG. 3 according to the exemplary embodiment of the present disclosure.

FIG. 4 is a detailed configuration diagram of the effect providing unit of FIG. 3 according to the exemplary embodiment of the present disclosure.

As illustrated in FIG. 4, the effect providing units 314 and 324 include first to fourth valves 411, 421, 431 and 441 and first to fourth nozzles 412, 422, 432 and 442.

The effect providing units 314 and 324 are connected with the control units 312 and 322 of each seat, respectively. The effect providing unit 324 of the second seat of the effect providing units 314 and 324 will be described below.

The first to fourth valves 411, 421, 431 and 441 of the effect providing unit 324 are connected with the control unit 322, respectively and controlled by the control unit 322. In the case where the second seat is placed as the seat set, when the control unit 322 controls the valve connected with the second seat in the seat set, a flow rate of the nozzle connected with the valve may be controlled. The first to fourth valves 411, 421, 431 and 441 are installed in the seat set in which first to fourth seats are configured as one set and installed on back surfaces of the first to fourth seats. The first to fourth valves 411, 421, 431 and 441 control flow rates ejected from the corresponding nozzles among the first to fourth nozzles 412, 422, 432 and 442, respectively.

Figure 5:
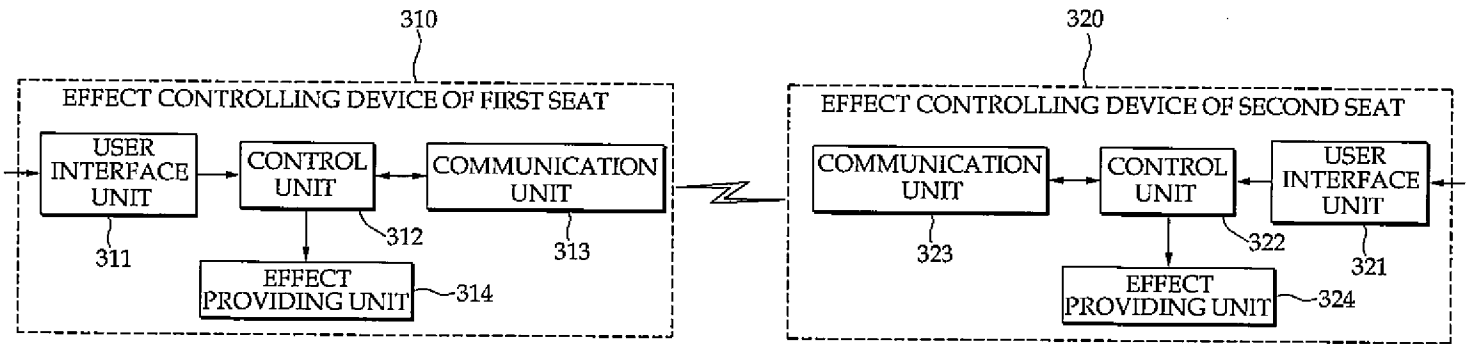
FIG. 5 is a configuration diagram of a system for controlling a seat effect for a facility of showing pictures according to a second exemplary embodiment of the present disclosure.

FIG. 5 is a configuration diagram of a system for controlling a seat effect for a facility of showing pictures according to a second exemplary embodiment of the present disclosure.

Hereinafter, contents duplicated with the first exemplary embodiment of the present disclosure are the same as described above and the effect controlling system according to the second exemplary embodiment will be described among parts which are different from those of the first exemplary embodiment.

As illustrated in FIG. 5, the effect controlling device 310 of the first seat and the effect controlling device 320 of the second seat are network-connected to each other through the wireless communication in advance. For example, the effect controlling device 310 of the first seat and the effect controlling device 320 of the second seat may be connected through the short-range wireless communication such as Zigbee, Bluetooth or the like.

The communication unit 313 of the effect controlling device 310 of the first seat and the communication unit 323 of the effect controlling device 320 of the second seat are network-connected to each other through the short-range wireless communication. In this case, the effect controlling devices 310 and 320 store, in advance, the network addresses of the effect controlling devices which the effect controlling devices 310 and 320 will transmit or receive for each of seats placed at the front and rear sides.

The communication unit 313 of the effect controlling device 310 of the first seat transmits the 4D control information inputted by the user to a predetermined network address of the effect controlling device 320 of the second seat. That is, the communication unit 313 of the first seat is connected with the communication unit 323 of the second seat through network connection and the communication unit 323 of the second seat receives the control information from the communication unit 313 of the first seat.

The effect controlling device 320 of the second seat provides the effect synchronized with the picture to the user who sits on the first seat with a predetermined network address, while controlling the 4D effect according to the control information transmitted from the effect controlling device 310 of the first seat.

Figure 6:
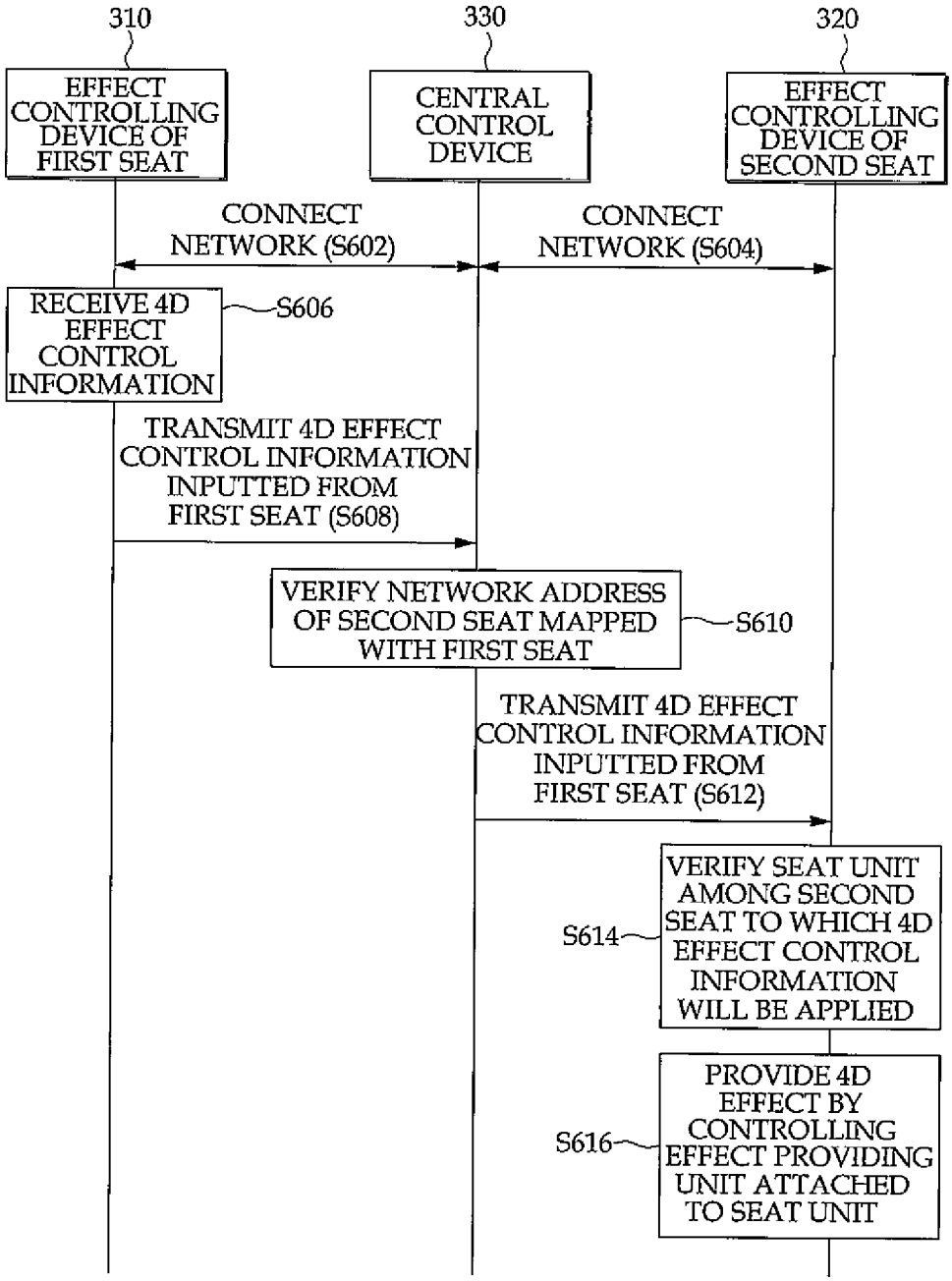
FIG. 6 is a flowchart of a method for controlling a seat effect for the facility of showing pictures according to the first exemplary embodiment of the present disclosure.

FIG. 6 is a flowchart of a method for controlling a seat effect for the facility of showing pictures according to the first exemplary embodiment of the present disclosure.

The effect controlling device 310 of the first seat is connected with the central control device 330 through the network (S602). The effect controlling device 320 of the second seat is connected with the central control device 330 through the network (S604). Herein, the network may be connected through the wired/wireless communication networks.

The effect controlling device 310 of the first seat verifies whether the user controls the 4D effect through the selection switch and the like and receives the 4D control information from the user (S606).

The effect controlling device 310 of the first seat transmits the 4D control information inputted from the first seat to the predetermined network address of the central control device 330 (S608).

The central control device 330 verifies the network address of the effect controlling device 320 of the second seat mapped with the first seat (S610). A mapping table of the network addresses among the seats to which the control information need to be transmitted is stored.

Subsequently, the central control device 330 transmits the 4D control information inputted from the first seat, to the network address of the effect controlling device 320 of the second seat (S612).

The effect controlling device 320 of the second seat verifies a corresponding seat unit among the second seats to which the 4D control information will be applied (S614).

Subsequently, the effect controlling device 320 of the second seat provides the 4D effect to the user by controlling the effect providing unit attached to the seat unit (S616).

Figure 7:
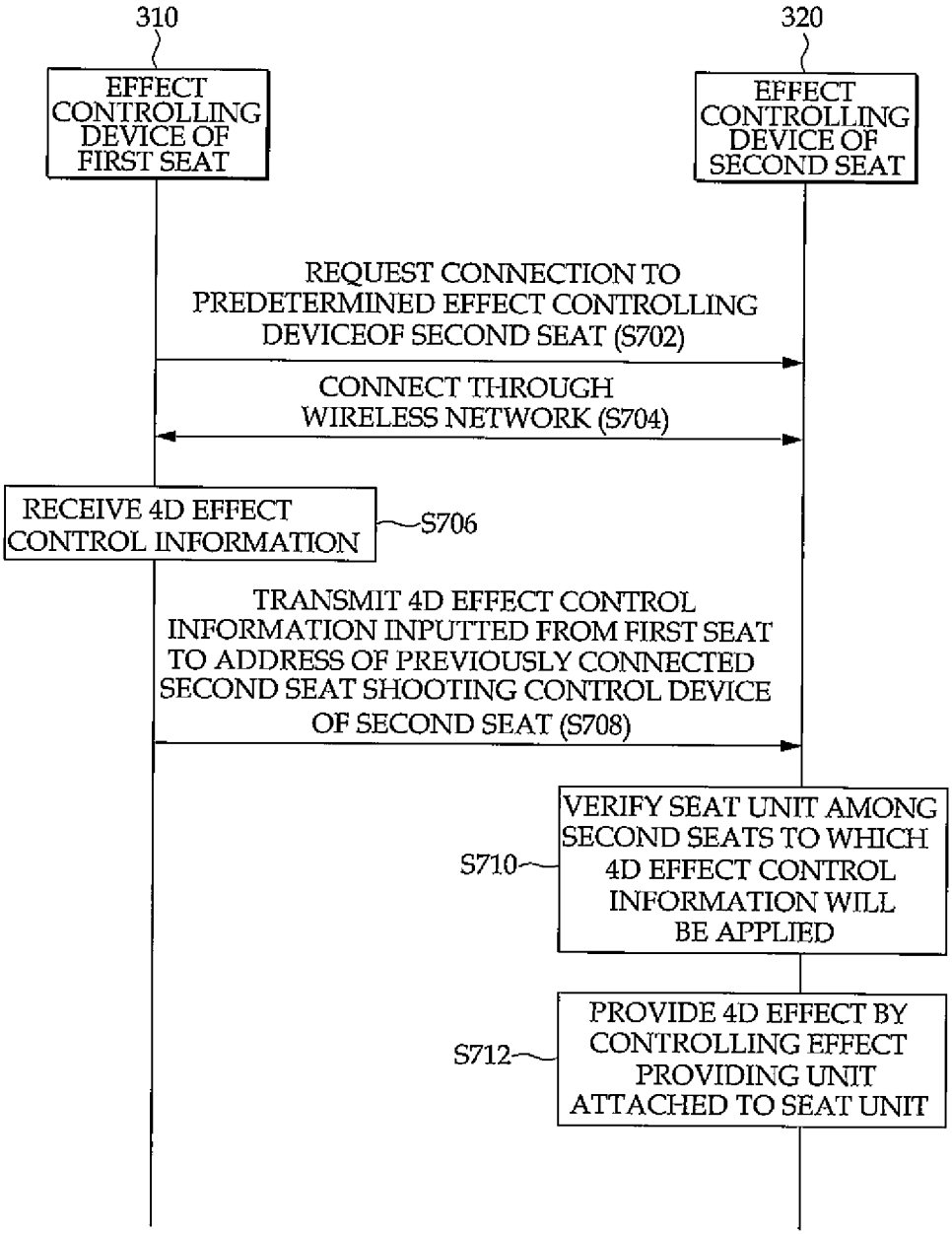
FIG. 7 is a flowchart of a method for controlling a seat effect for the facility of showing pictures according to the second exemplary embodiment of the present disclosure.

FIG. 7 is a flowchart of a method for controlling a seat effect for the facility of showing pictures according to the second exemplary embodiment of the present disclosure.

The effect controlling device 310 of the first seat requests connection with the predetermined effect controlling device 320 of the second seat (S702).

The effect controlling device 310 of the first seat and the effect controlling device 320 of the second seat are connected through the wireless network (S704).

The effect controlling device 310 of the first seat receives the 4D control information from the user (S706).

The effect controlling device 310 of the first seat verifies a previously connected network address of the effect controlling device 320 of the second seat and transmits the 4D control information to the verified network address of the effect controlling device 320 of the second seat (S708).

The effect controlling device 320 of the second seat verifies a corresponding seat unit among the second seats to which the 4D control information will be applied (S710).

Subsequently, the effect controlling device 320 of the second seat provides the 4D effect to the user by controlling the effect providing unit attached to the seat unit (S712).

From the foregoing, it will be appreciated that various embodiments of the present disclosure have been described herein for purposes of illustration, and that various modifications may be made without departing from the scope and spirit of the present disclosure. Therefore, the exemplary embodiments disclosed in the specification of the present disclosure do not limit the present disclosure. The scope of the present disclosure should be analyzed by the appended claims and it should be analyzed that all arts in the equivalent scope are included in the scope of the present disclosure.

The present disclosure relates to a system for controlling a seat effect for a facility of showing pictures, and particularly, a user on a rear line may easily and safely control an effect provided to the user himself/herself even while a seat is in motion operation at the time of showing pictures by controlling an effect synchronized with pictures by relaying control information inputted from the user on the rear-line seat by using an effect controlling device of a front-line seat, in the facility of showing pictures, which provides the effect (for example, a water shot, an air shot, or a scent) synchronized with the pictures to the user on the rear-line seat. From this point of view, as the present disclosure exceeds a limit of an existing technology, marketing or business possibility of an applied apparatus as well as using an associated technology is sufficient and the present disclosure can be obviously worked, and thus the present disclosure has industrial applicability.

The invention claimed is:

1. A system configured to provide an effect synchronized with a picture in a facility of showing pictures, comprising:

a first controlling device of a seat configured to transmit control information including an effect type or an effect strength inputted from a user;

a second effect controlling device positioned at a front space of the seat configured to provide the effect synchronized with the picture to a space in the seat; and a central control device configured to relay the control information received from the first controlling device to the second controlling device, wherein the central control device configured to verify a mapping between the first controlling device and the second controlling device for relaying the control information; and the second controlling device provides the seat effect in accordance with the control information relayed through the central control device.

2. The system configured to provide an effect synchronized with a picture in a facility of showing pictures of claim 1, wherein the second controlling device receives control information including the effect type or the effect strength from the central control device, controls a valve corresponding to the received effect type or the effect strength connected with the second controlling device for controlling a flow rate of a nozzle connected with the valve.

3. The system configured to provide an effect synchronized with a picture in a facility of showing pictures of claim 1, wherein the second controlling device provides at least one of a water shot effect, an air shot effect and a scent effect to the user.

4. A system configured to provide an effect synchronized with a picture in a facility of showing pictures, comprising:

a first controlling device of a seat configured to transmit control information including an effect type or an effect strength inputted from a user; and a second controlling device configured to provide the provided effect in accordance with control information received from the first controlling device, wherein the first controlling device and the second controlling device are, in advance, network-connected to each other through wireless communication; and the second controlling device provides the effect synchronized with the picture to a space in the seat.

5. The system for controlling a seat effect for a facility of showing pictures of claim 4, wherein the second controlling device receives control information including the effect type or the effect strength from the first controlling device, controls a valve corresponding to the received effect type or the effect strength connected with the second controlling device for controlling a flow rate of a nozzle connected with the valve.

6. The system configured to provide an effect synchronized with a picture in a facility of showing pictures of claim 4, wherein the second controlling device provides at least one of a water shot effect, an air shot effect and a scent effect to the user.

* * * * *